United States Patent [19]

Chase

[11] 4,138,831

[45] Feb. 13, 1979

[54] VANE ADJUSTING MECHANISM FOR A POWERED SNOW THROWER

[75] Inventor: Alan L. Chase, Oostburg, Wis.

[73] Assignee: Allis-Chalmers Corporation, Milwaukee, Wis.

[21] Appl. No.: 881,004

[22] Filed: Feb. 24, 1978

[51] Int. Cl.[2] ..... E01H 5/00

[52] U.S. Cl. ..... 37/43 D; 193/2 A

[58] Field of Search ..... 37/43 R, 43 A–43 K, 37/20–27; 193/2 R, 2 A, 28–30, 33–34; 254/10R

[56] References Cited

U.S. PATENT DOCUMENTS

| | | | |
|---|---|---|---|
| 3,359,667 | 12/1967 | Speiser et al. | 37/43 D |
| 3,452,460 | 7/1969 | Cope et al. | 37/43 D |

FOREIGN PATENT DOCUMENTS

| | | | |
|---|---|---|---|
| 845605 | 7/1956 | Canada | 37/43 R |
| 416726 | 12/1946 | Italy | 37/43 D |
| 123618 | 12/1948 | Sweden | 37/43 D |

*Primary Examiner*—E. H. Eickholt

*Attorney, Agent, or Firm*—Charles L. Schwab

[57] ABSTRACT

A compact, lightweight snow thrower having a power driven impeller rotating about a horizontal, transverse axis to throw snow upwardly and forwardly through a chute which is substantially coextensive in width with the axial length of the impeller. A plurality of laterally spaced upright vanes are disposed in and pivotally connected to the upper end of the chute for the purpose of directing the discharge of snow. A vane adjusting mechanism includes a transverse, laterally shiftable vane adjusting bar which is connected to the vanes through pairs of laterally spaced fingers extending forwardly from the control bar on opposite lateral sides of the vanes. Lateral shifting movement of the bar effects simultaneous lateral tilting of the vanes. The vane adjusting bar includes a pair of rearwardly extending stud parts which extend through slots in the rear wall part of the transverse recess in the rear wall of the discharge chute in which the bar is disposed. The slots and stud parts cooperate to guide the control bar when it is shifted between an intermediate position in which the vanes direct the discharged snow straight ahead and laterally adjusted positions in which the vanes direct the snow discharged through the chute to one lateral side or the other. The recess for the control bar is sufficiently deep so that the control bar is disposed therein and does not interfere with discharge of snow through the chute and a resilient detent is provided to selectively, releasably hold the control bar in its intermediate and laterally adjusted positions.

9 Claims, 7 Drawing Figures

VI
V
53
54
57
17
56
16
161
162
163
164
165
166
167
168
99
101
116
118
121
122
119
117
114
103
102
100
72
71
74
110
68
67
66
65
64
63
62
61
81
98
113
97
96
95
94
93
92
91
90
89
88
87
86
85
84
83
82
112
99
100

VANE ADJUSTING MECHANISM FOR A POWERED SNOW THROWER

RELATED APPLICATIONS

Various features of the snow thrower disclosed herein are shown in my copending patent applications of even filing date entitled "Discharge Vane Arrangement for a Powered Snow Thrower" and "Snow Thrower With Combined Discharge Vane Support and Strike-Off Wall."

TECHNICAL FIELD OF THE INVENTION

This invention relates to a walk-behind snow thrower of the type having a power impeller which rotates about a horizontal transverse axis to throw snow upwardly and forwardly through a discharge chute.

BACKGROUND OF THE INVENTION

Lightweight snow throwers of a type using a powered impeller disposed on a transverse horizontal axis and an upwardly and forwardly directed discharge chute with directional vanes are shown in U.S. design Pat. Nos. 241,762, 205,531, 209,305 and 208,199; in U.S. Pat. Nos. 3,359,661 and 3,452,460 and in Norweigian patent 74,014. Vehicular mounted snow throwers having vanes for directing the discharge of snow are shown in U.S. Pat. Nos. 2,498,522 and 2,706,864.

SUMMARY OF THE INVENTION

The invention is incorporated in a snow thrower of the type including an impeller at the front thereof mounted for rotation on a horizontal transverse axis, power means for rotating the impeller to achieve a discharge of snow and wall means defining a discharge chute disposed above and extending transversely substantially coextensive with the impeller. A plurality of laterally spaced, upright vanes are pivotally connected to the rear wall of the chute for lateral tilting movement between left discharge, straight ahead discharge and right discharge positions. A vane adjusting bar is disposed in a recess in the rear wall and motion transmitting means are provided to connect the bar to the vanes. Control means are provided for reciprocating the bar in the recess to simultaneously move the vanes between their left, right and straight ahead discharge positions.

The vanes may be pivoted at their upper ends to the top of the rear wall of the discharge chute. The upper ends of the vanes may also be pivotally connected to a front wall provided in the chute construction.

The control means may include a rearwardly projecting stud on the bar which is connected to a manually operated vane control member. The opposite ends of the vane adjusting bar may have tapered edges operable to scrape away snow deposited in the recess in which the bar operates. The motion transmitting means may include a pair of fingers for each vane, the fingers being formed on and projecting forwardly from the bar. Further, a resilient detent means may be provided to detain the vane adjusting bar in its positions of adjustment for left, right and straight ahead discharge.

BRIEF DESCRIPTION OF THE DRAWINGS

One embodiment of the invention is illustrated in the drawings in which.

DETAILED DESCRIPTION OF THE INVENTION

Figure 1:
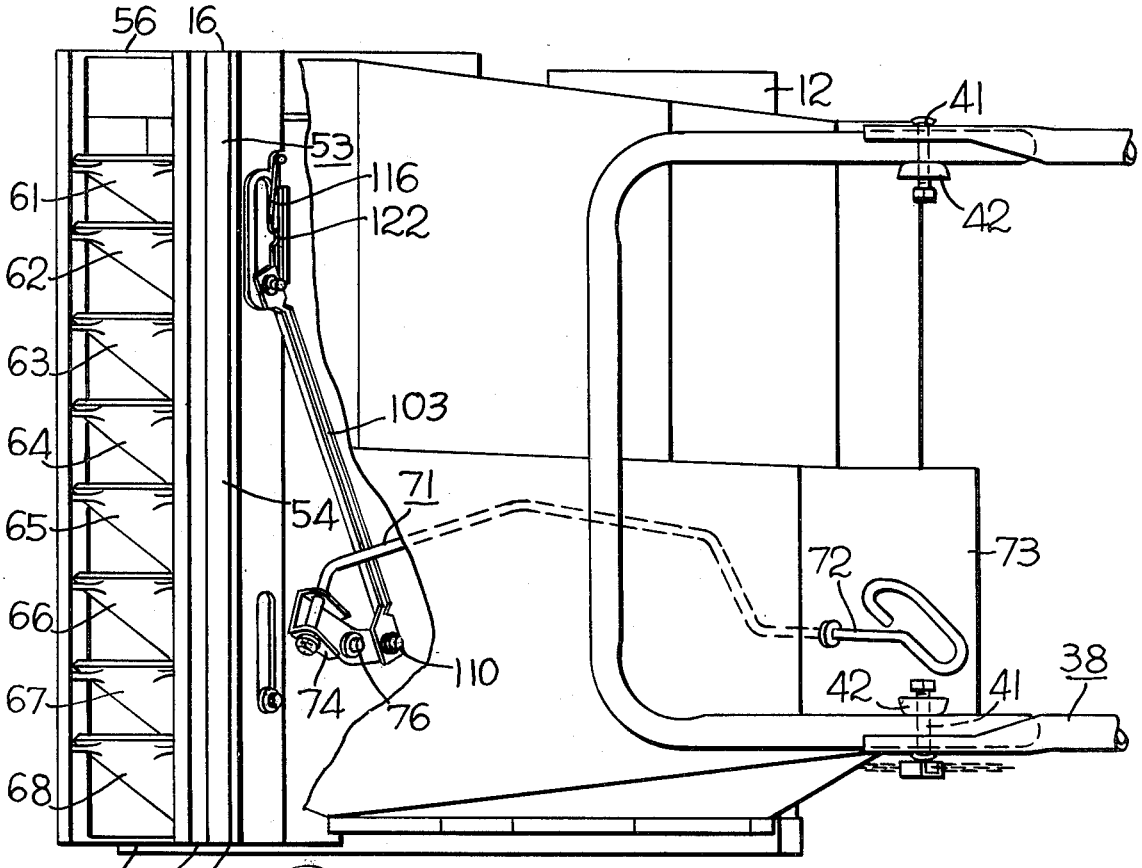
FIG. 1 is a top view of the lightweight snow thrower incorporating the present invention.
Figure 2:
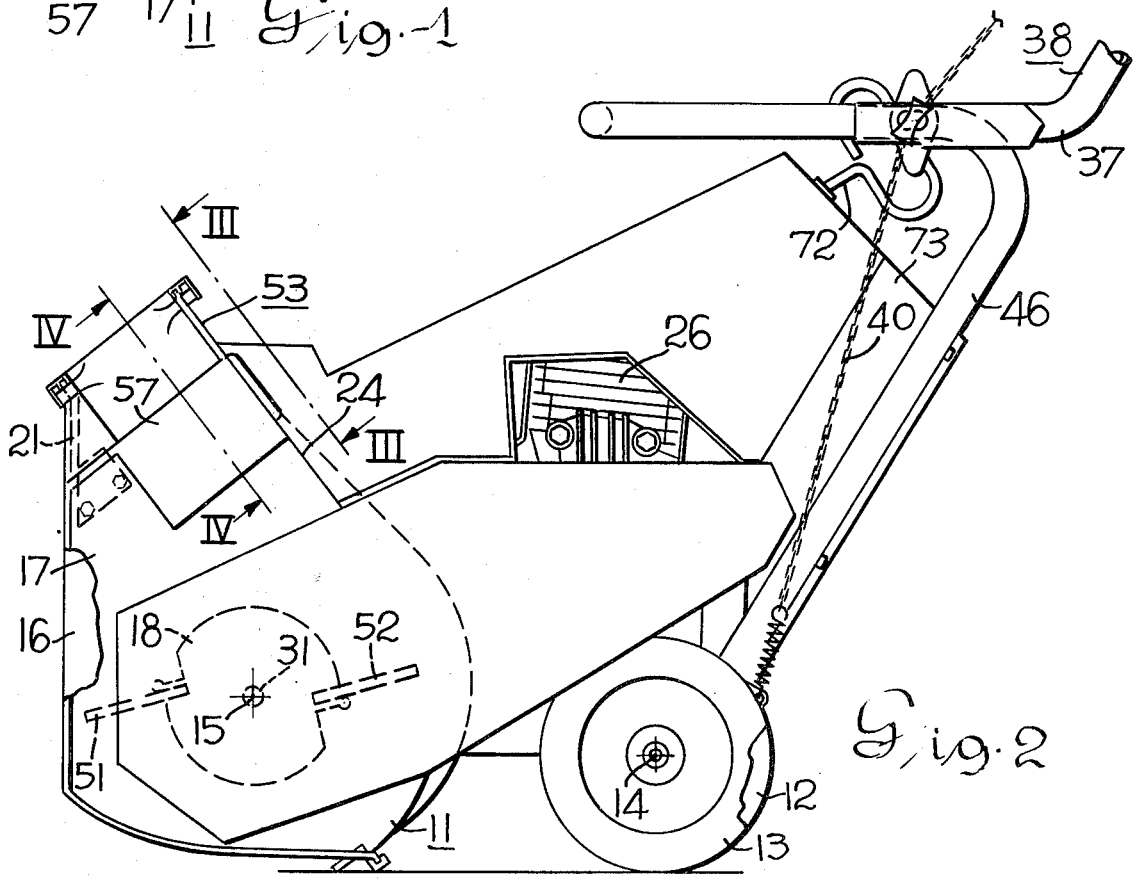
FIG. 2 is a left side view of the snow thrower illustrated in FIG. 1.

As illustrated in FIGS. 1 and 2, the lightweight snow thrower of the present invention includes a housing 11 supported on a pair of laterally spaced wheels 12, 13 which rotate about a transverse axis 14. The housing 11 includes a pair of vertical walls 16, 17 at laterally opposite sides of the snow thrower which support the shaft 31 of an impeller 18 by suitable bearings (not shown) for rotation about a horizontal, transverse axis 15. The impeller 18 is driven by a small, air cooled, internal combustion engine 26 through a drive train, not shown. The drive train includes a clutching device, not shown which is operated by a suitable flexible control member such as the illustrated chain 40. A two-piece handle 38 is provided for the walk-behind operator. The upper part 37 is connected to the lower part 46 by pivot bolts 41 and nuts 42. The lower part 46 of the handle 38 is secured at its lower end by means (not shown) to the housing 11.

Figures 3, 4:
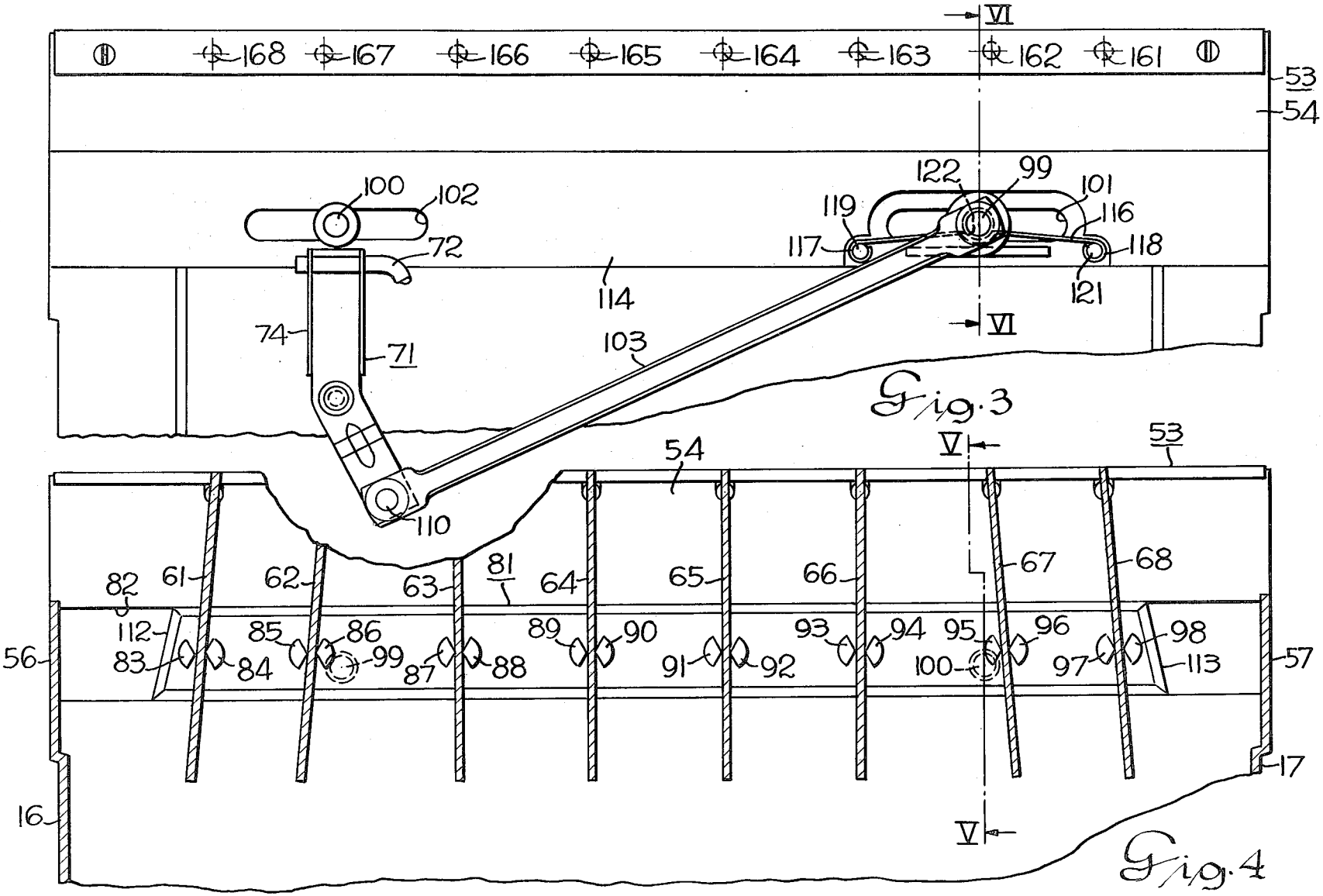
FIG. 3 is a view taken along the line III—III in FIG. 2 with the cover removed.
FIG. 4 is a section view taken along the line IV—IV but showing the vanes adjusted to a forward discharge position.
Figure 5:
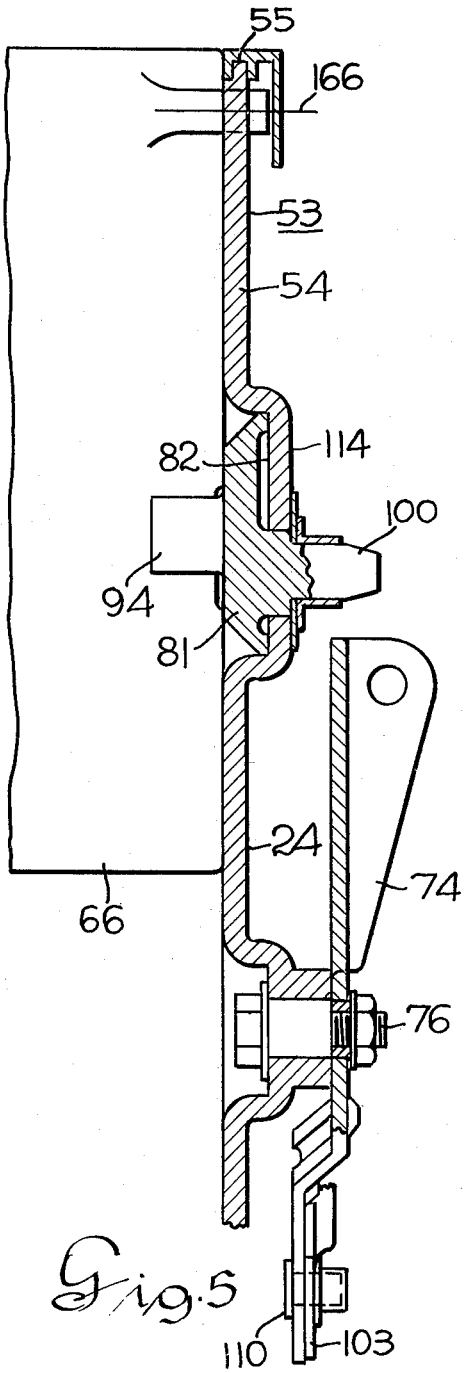
FIG. 5 is a section view taken along the line V—V in FIG. 4.

The impeller 18 is rotated in a counterclockwise direction as viewed in FIG. 2 and the two transverse rubber-like paddles 51, 52 throw the snow upwardly through a forwardly and upwardly disposed discharge chute 53. The chute is defined by a flat upper wall portion 54 of the rear wall 24, a front wall 21 and a pair of sidewalls 56, 57 which are, in effect, continuations of walls 16 and 17, respectively. The lateral dimension of the discharge chute 53 is substantially coextensive with the axial length of the impeller 18. Referring also to FIG. 4, the discharge of snow from the chute 53 is controlled by a plurality of vanes 61–68. The upper ends of the vanes 61–68 are approximately coterminous with the upper ends of the front and rear walls 21, 54 of the chute 53. In order to permit lateral tilting adjustment of the vanes 61–68, the upper ends are pivotally connected at the upper ends of the front and rear walls 21, 54 of the chute 53 on a plurality of parallel, laterally spaced axes 161–168.

Referring also to FIGS. 3, 5, 6 and 7, a manually operated vane adjusting mechanism 71 includes a manually operated control rod 72 pivotally mounted in a cover portion 73 of the housing 11 which has its lower end connected to a control lever 74 pivotally mounted on the rear wall 24 of the housing 11 by a bolt 76. The vane adjusting mechanism 71 also includes laterally shiftable control element in the form of a vane adjusting bar 81 which fits within a recess 82 in the back wall 54 of the discharge chute 53 a predetermined distance from the upper end 55 of the latter. The bar 81 is disposed within the recess so as not to interfere with discharge of snow through the chute 53. The control bar 81 includes motion transmitting means in the form of a plurality of fingers 83–98 which are formed on and project forward from the front of the vane adjusting bar 81 to engage opposite lateral sides of the vanes. The fingers act in pairs to space the vanes laterally of one another and serve as fulcrums or lateral thrust transmitting parts to cause the vanes to tilt laterally when the control bar 81 is adjusted laterally in the recess 82.

The bar 81 has a pair of rearwardly projecting, cylindrical stud parts 99, 100 which extend through slots 101, 102 in the portion of the rear wall 54 constituting the rear wall 114 of the recess 82. A control link 103 is pivotally connected at one of its ends to stud part 99 and at the other of its ends to a lower end of the control lever 74 by a pivot pin 110.

Figure 6:
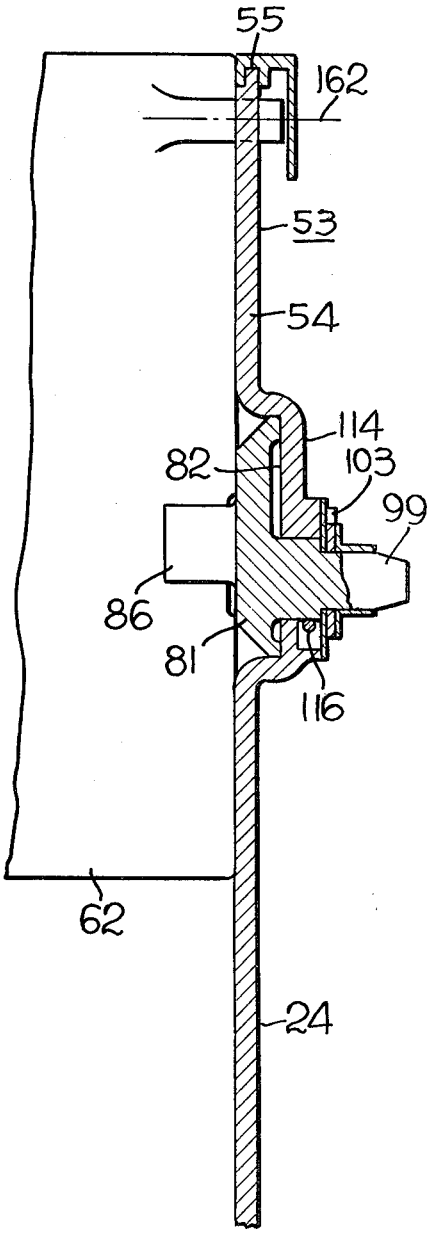
FIG. 6 is a section view taken along the line VI—VI in FIG. 3.
Figure 7:
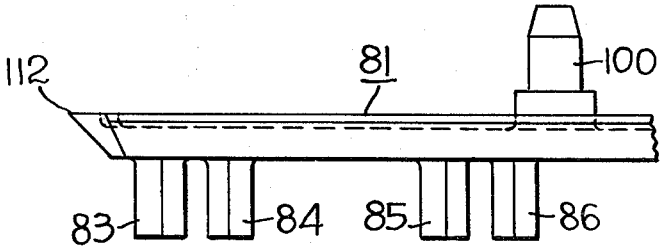
FIG. 7 is a top view of one end of the vane adjusting bar.

As shown in FIGS. 4 and 7, the laterally opposite edges of the bar 81 are tapered to scraping edges 112, 113 adjacent the rear wall 114 of the recess 82 which serve to scrape away snow deposited in the recess 82 when the bar is shifted laterally therein. The bar 81 is releasably detained or detented in its lateral positions of adjustment corresponding to left, right and straight ahead discharge of snow, by resilient detent means in the form of a spring member 116 having end loops 117, 118 mounted on small studs 119, 121. The spring member is curved downwardly at its center to provide a notch 122 which releasably engages the stud part 99, as shown in FIGS. 3 and 6, in the straight ahead discharge position of the vanes 61–68. The slope of the spring member 116 biases or resiliently detains the bar 81 in its right and left discharge positions of adjustment through resilient engagement of the spring member 116 with the stud part 99.

OPERATION AND USE OF THE INVENTION

The walk-behind operator is able to adjust the vanes 61–68 by manually operating the control handle or rod 72 of the vane adjusting mechanism 71. The vanes 61–68 and the vane adjusting bar 81 are adjusted to a straight ahead discharge position in FIGS. 3 and 4 in which position the snow thrown through the chute 53 by the impeller will be directed by the vanes 61–68 in a generally upward and forward direction.

The vanes are adjusted to a right discharge position in FIG. 1. This is achieved by rotating the control rod 72 clockwise, as viewed from the rear, thereby shifting the control bar to the left. In a similar manner the vanes are adjusted for snow discharge to the left by turning the control rod in a counterclockwise direction.

From the foregoing description, it is believed apparent that a novel vane adjusting mechanism for a snow thrower has been provided. The vane adjusting bar 81 is recessed into the rear wall 54 of the discharge chute 53 sufficiently to avoid catching snow discharged through the chute. The ends of the vane adjusting bar are tapered to a scraping edge to assist in keeping the recess 82 free of snow. The laterally elongated openings or slots 101, 102 in the rear wall portion 114 of the recess cooperate with the stud parts 99, 100 to help guide the bar 81 in its lateral reciprocation in the recess 82 during manual adjustment of the vanes by the control 71. A spring member 116 operates as a resilient detent for releasably holding the vane adjusting bar in its left, right and straight ahead positions of adjustment.

The embodiments of the invention in which an exclusive property or privilege is claimed are defined as follows:

1. In a snow thrower having an impeller at the front thereof rotatable about a horizontal transverse axis, wall means defining a discharge chute including a rear wall with a lower portion curving upwardly at the rear of the impeller from a bottom transverse scraper edge and an upper flat portion extending in an upward and forward direction, the discharge chute being disposed above and extending transversely substantially coextensive with said impeller, the improvement characterized by:

a plurality of vertically disposed discharge directing vanes pivotally connected to said rear wall for movement between left discharge, straight ahead discharge and right discharge positions, a transversely extending, forward opening recess in the upper portion of said rear wall, a vane adjusting bar disposed in said recess so as to substantially avoid interference with the movement of snow through said discharge chute, motion transmitting means connecting said vanes to said bar, and control means for reciprocating said bar in said recess to simultaneously move said vanes between left, right and straight ahead discharge positions.

2. The snow thrower of claim 1 wherein said bar includes a pair of rearwardly projecting stud parts and said upper portion of said rear wall includes laterally spaced transversely extending slots through which said stud parts extend.

3. The snow thrower of claim 2 wherein said control means includes a control element connected in laterally motion transmitting relation to one of said stud parts.

4. The snow thrower of claim 1 wherein said vanes are pivotally connected at their upper ends to the upper end of said rear wall.

5. The snow thrower of claim 1 wherein said wall means includes a front wall and wherein said vanes are pivotally connected to said front wall.

6. The snow thrower of claim 1 wherein the laterally opposite ends of said bar taper to a scraping edge adjacent the rear wall portion of said recess which is operable to scrape away snow deposited in said recess when said bar is shifted therein.

7. The snow thrower of claim 1 wherein said motion transmitting means includes pairs of laterally spaced fingers, disposed on opposite laterally sides of said vanes.

8. The snow thrower of claim 1 wherein a laterally elongated opening is formed in the portion of the rear wall defining said recess, said bar includes a connecting part extending rearwardly through said opening and said control means includes a motion transmitting element connected to said connecting part.

9. The snow thrower of claim 1 and further comprising resilient detent means in engagement with said bar operative to releaseably detain said bar in its positions of adjustment corresponding to said left, right and straight ahead discharge postions of said vanes.

* * * * *